US006961031B2

(12) United States Patent
Lee et al.

(10) Patent No.: US 6,961,031 B2
(45) Date of Patent: Nov. 1, 2005

(54) APPARATUS AND METHOD FOR DRIVING A PLASMA DISPLAY PANEL

(75) Inventors: Jun-Young Lee, Cheonan (KR); Jin-Sung Kim, Anyang (KR)

(73) Assignee: Samsung SDI Co., Ltd., Suwon (KR)

( * ) Notice: Subject to any disclaimer, the term of this patent is extended or adjusted under 35 U.S.C. 154(b) by 380 days.

(21) Appl. No.: 10/401,558

(22) Filed: Mar. 31, 2003

(65) Prior Publication Data

US 2003/0193450 A1 Oct. 16, 2003

(30) Foreign Application Priority Data

Apr. 15, 2002 (KR) ..... 10-2002-0020397

(51) Int. Cl.[7] ..... G09G 3/28
(52) U.S. Cl. ..... 345/60; 345/169.3; 345/211; 345/212
(58) Field of Search ..... 345/60, 169.3, 345/211, 212

(56) References Cited

U.S. PATENT DOCUMENTS 6,657,604 B2 * 12/2003 Huang et al. ..... 345/60
6,768,270 B2 * 7/2004 Chae ..... 315/169.3
2001/0054994 A1 * 12/2001 Hsu et al.

FOREIGN PATENT DOCUMENTS

KR 1020030003564 A 10/2003 ..... G09G 3/288

* cited by examiner

*Primary Examiner*—Sumati Lefkowitz
*Assistant Examiner*—Tammy Pham
(74) *Attorney, Agent, or Firm*—McGuireWoods, LLP

(57) ABSTRACT

An apparatus for driving a plasma display panel includes a first signal line and a second signal line for supplying a first voltage and a second voltage, respectively, and a first inductor and a second inductor being to one terminal of a panel capacitor. A first current path is formed from the panel capacitor to the second signal line via the second inductor to reduce a voltage of the panel capacitor from the first voltage to the second voltage. A second current path is formed to recover a current flowing to the second inductor to the first signal line, when the voltage of the panel capacitor is sustained at the second voltage. A third current path is formed from the first signal line to the panel capacitor via the first inductor while the current flowing to the second inductor is recovered, thereby increasing the voltage of the panel capacitor from the second voltage to the first voltage. A fourth current path is formed to recover a current flowing to the first inductor to the first signal line, while the voltage of the panel capacitor is sustained at the first voltage.

19 Claims, 4 Drawing Sheets

APPARATUS AND METHOD FOR DRIVING A PLASMA DISPLAY PANEL

CROSS REFERENCE

This application claims the benefit of Korean Patent Application No. 2002-0020397, filed on Apr. 15, 2002, which is hereby incorporated by reference for all purposes as if fully set forth herein.

BACKGROUND OF THE INVENTION

1. Field of the Invention

The present invention relates to an apparatus and method for driving a plasma display panel. More specifically, the present invention relates to a driver circuit for plasma display panels.

2. Background Description

In recent years, flat panel displays such as liquid crystal displays (LCD), field emission displays (FED), plasma display panels (PDP), and the like have been actively developed. The PDP is advantageous over other flat panel displays in regard to its high luminance, high luminous efficiency, and wide viewing angle, and accordingly, it is favorable for making a large-scale screen bigger than 40 inches as a substitute for the conventional cathode ray tube (CRT).

The PDP is a flat panel display that uses plasma generated by gas discharge to display characters or images, and it includes, according to its size, more than several scores to millions of pixels arranged in a matrix pattern. Such a PDP is classified into a direct current (DC) type and an alternating current (AC) type according to its discharge cell structure and the waveform of the driving voltage.

The DC PDP has electrodes exposed to a discharge space to allow a DC to flow through the discharge space when voltage is applied. This requires a resistance for limiting the current. In contrast, the AC PDP has electrodes covered with a dielectric layer that naturally form a capacitance component to limit the current and to protect the electrodes from the impact of ions during discharge. This is superior to the DC PDP in terms of longevity.

Typically, the driving method of the AC PDP comprises a reset (initialization) step, an addressing (write) step, a sustain discharge step, and an erase step.

In the reset step, each cell is initialized in order to readily perform a subsequent addressing operation on the cell. In the write step, wall charges are formed on selected "on"-state cells (i.e., addressed cells) in the panel. In the sustain step, a discharge occurs to actually display an image on the addressed cells. In the erase step, the wall charges on the cells are erased to end the sustain discharge.

In the AC PDP, the panel between address electrodes, sustain electrodes, and scan electrodes acts as a capacitance load and is therefore called a panel capacitor. Due to the capacitance of the panel capacitor, reactive power is necessary in order to apply a waveform for addressing or sustain discharge. A circuit for recovering the reactive power and reusing it is called a "power recovery circuit", some of which are suggested by L. F. Weber in U.S. Pat. Nos. 4,866,349 and 5,081,400.

In conventional power recovery circuits, however, 100% energy recovery is impossible due to turn-on loss of switches and loss due to the circuit itself, such as switching loss during the recovery process. Accordingly, the address voltage and the sustain discharge voltage cannot be changed to a desired voltage using switches performing hard switching that cause a loss of power. Moreover, the rise/fall time of the address voltage is increased in order to reduce the addressing speed.

SUMMARY OF THE INVENTION

In an aspect of the present invention, there is provided an apparatus for driving a PDP that includes a first inductor and a second inductor; first, second, and third switches; and first, second, and third diodes. The first switch and the first diode are coupled in series between a first power source for supplying a first voltage and a second power source for supplying a second voltage. The contact between the first switch and the first diode is coupled to one terminal of a panel capacitor. The first inductor and second inductor each have one terminal coupled in parallel to the contact between the first switch and the first diode. The second switch is coupled between the first power source and the other terminal of the first inductor. The third switch is coupled between the other terminal of the second inductor and the second power source. The second diode is coupled between the first power source and the other terminal of the second inductor, and the third diode is coupled between the other terminal of the first inductor and the second power source.

In another aspect of the present invention, there is provided an apparatus for driving a PDP that includes a first signal line and a second signal line for supplying a first voltage and a second voltage, respectively, and a first inductor and a second inductor coupled to one terminal of a panel capacitor.

A first current path is formed from the panel capacitor to the second signal line via the second inductor, to reduce a voltage of the panel capacitor from the first voltage to the second voltage. A second current path is formed to recover a current flowing to the second inductor to the first signal line, when the voltage of the panel capacitor is sustained at the second voltage. A third current path is formed from the first signal line to the panel capacitor via the first inductor while the current flowing to the second inductor is recovered, thereby increasing the voltage of the panel capacitor from the second voltage to the first voltage. A fourth current path is formed to recover a current flowing to the first inductor to the first signal line, while the voltage of the panel capacitor is sustained at the first voltage.

The current flowing to the second inductor on the first current path is changed to have a ¼ sine wave cycle by a resonance between the panel capacitor and the second inductor. Likewise, the current flowing to the first inductor on the third current path is changed to have a ¼ sine wave cycle by a resonance between the panel capacitor and the first inductor.

In another aspect of the present invention, there is provided a method for driving a PDP. According to the method, the voltage of the panel capacitor, charged to a first voltage, is changed to a second voltage using an LC resonance with a first inductor coupled to the panel capacitor. The terminal voltage of the panel capacitor is sustained at the second voltage while recovering a current flowing to the first inductor to a first power source for supplying the first voltage. Then the voltage of the panel capacitor is changed to the first voltage using an LC resonance with a second inductor coupled to the panel capacitor, while the current flowing to the first inductor is recovered to the first power source. The terminal voltage of the panel capacitor is sustained at the first voltage while recovering a current flowing to the second inductor to the first power source.

BRIEF DESCRIPTION OF THE DRAWINGS

The accompanying drawings, which are incorporated in and constitute a part of the specification, illustrate an embodiment of the invention, and, together with the description, serve to more fully explain the principles of the invention.

DETAILED DESCRIPTION OF PREFERRED EMBODIMENTS

In the following detailed description, only the preferred embodiment of the invention has been shown and described, simply by way of illustration of the best mode of carrying out the invention. As will be realized by one of ordinary skill in the art, the invention is capable of modification in various obvious respects, all without departing from the invention. Accordingly, the drawings and description are to be regarded as illustrative in nature, and not restrictive.

Figure 1:
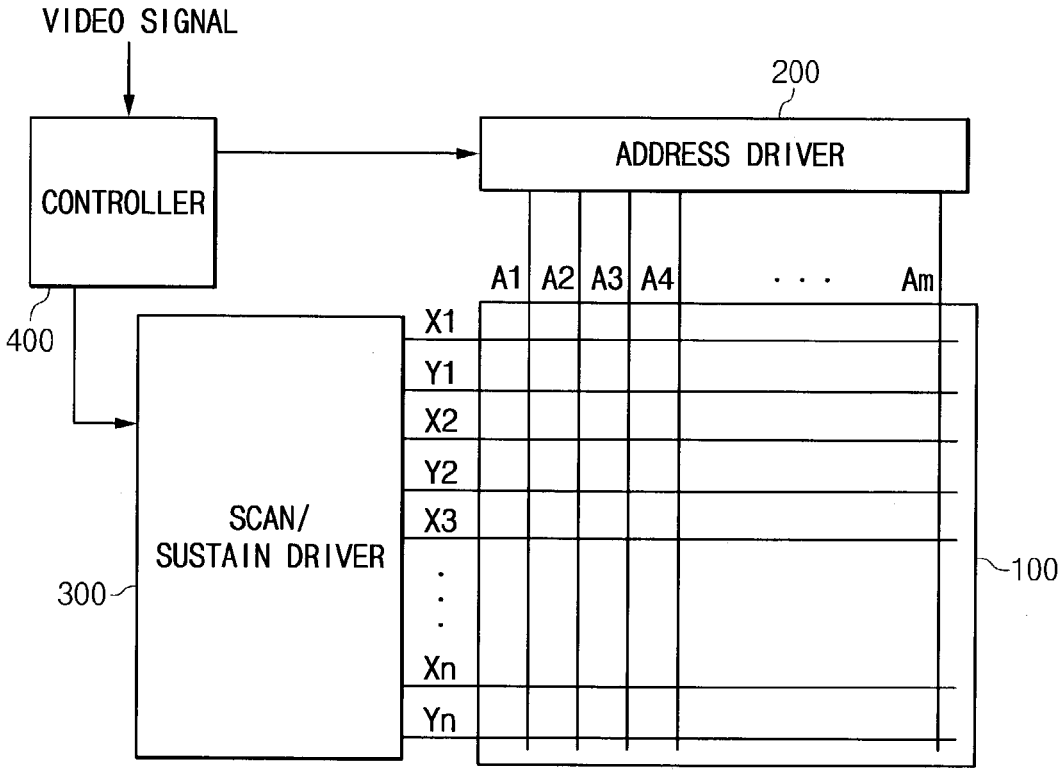
FIG. 1 is an illustration of a PDP according to an embodiment of the present invention.

FIG. 1 describes a PDP according to the embodiment of the present invention, wherein the PDP comprises a plasma panel 100, an address driver 200, a scan/sustain driver 300, and a controller 400.

The plasma panel 100 comprises a plurality of address electrodes $A_1$ to $A_m$ arranged in columns, and a plurality of scan electrodes $Y_1$ to $Y_n$ and sustain electrodes $X_1$ to $X_n$ alternately arranged in rows. The controller 400 receives an external image signal (i.e., video signal), generates an address drive control signal and a sustain discharge control signal, and applies them to the address driver 200 and the scan/sustain driver 300, respectively.

The address driver 200 receives the address drive control signal from the controller 400, and applies a display data signal to the individual address electrodes for selection of discharge cells to be displayed. The scan/sustain driver 300 receives the sustain discharge control signal from the controller 400, and applies a sustain pulse voltage alternately to the scan and sustain electrodes for a sustain discharge on the selected discharge cells. The address driver 200 and the scan/sustain driver 300 each includes a driver circuit (i.e., power recovery circuit) for recovering reactive power and reusing it.

Below is a description of a power recovery circuit 210 as included in the address driver 200 according to the embodiment of the present invention, with reference to FIGS. 2 to 4.

Figure 2:
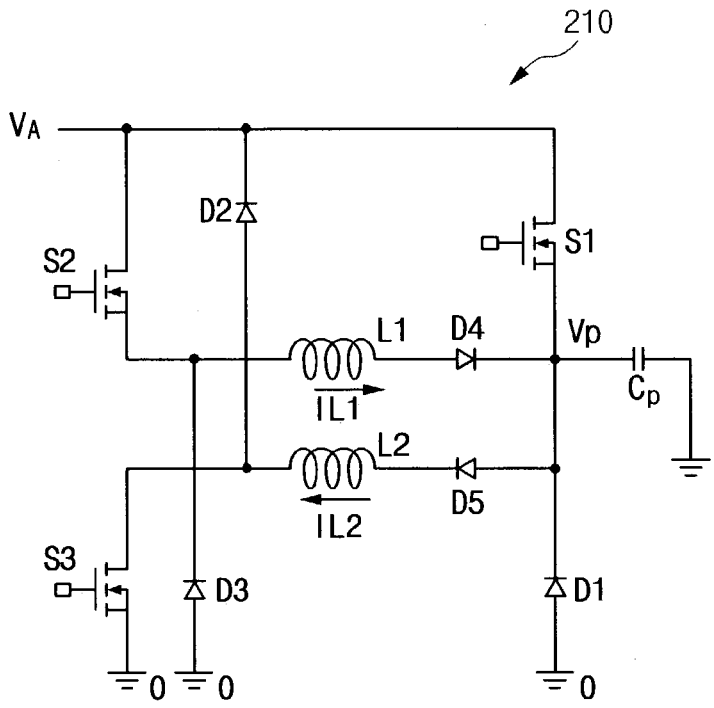
FIG. 2 is a circuit diagram of a power recovery circuit according to the embodiment of the present invention.

The power recovery circuit 210 according to the embodiment of the present invention is, as shown in FIG. 2, coupled to one electrode of a panel capacitor $C_p$ via an address driving IC (not shown). The first voltage applied to the other electrode of the panel capacitor $C_p$ and the second voltage applied through the power recovery circuit 210 operate together to be used for selecting discharge cells, and the first voltages is assumed to be a ground voltage 0V in FIG. 2.

The address driving IC is omitted in the discussion to follow and it is assumed that the power recovery circuit is coupled to the panel capacitor $C_p$.

The power recovery circuit 210 includes inductors $L_1$ and $L_2$, switches $S_1$, $S_2$, and $S_3$, and diodes $D_1$, $D_2$, and $D_3$. Although the switches $S_1$, $S_2$, and $S_3$ are denoted as MOSFETs in FIG. 2, they are not specifically limited to MOSFETs and may include any switches that perform the same or similar functions. Preferably, these switches have a body diode such as the pn junction separation structure of semiconductor integrated circuits.

The switch $S_1$ and the diode $D_1$ are coupled in series between a power source $V_A$ supplying an address voltage $V_a$, and a ground terminal 0. To the contact between the switch $S_1$ and the diode $D_1$ is coupled the panel capacitor $C_p$. The switch $S_2$ and the inductor $L_1$ are coupled in series between the power source $V_A$ and the contact between the switch $S_1$ and the diode $D_1$. And the inductor $L_2$ and the switch $S_3$ are coupled in series between the contact and the ground terminal 0.

The diode $D_2$ is coupled between the power source $V_A$ and a contact between the inductor $L_2$ and the switch $S_3$. The diode $D_3$ is coupled between a contact between the switch $S_2$ and the inductor $L_1$, and the ground terminal 0.

The power recovery circuit 210 may further comprise diodes $D_4$ and $D_5$ formed on a current path of the switch $S_2$ and the inductor $L_1$, and a current path of the switch $S_3$ and the inductor $L_2$, respectively. The diodes $D_4$ and $D_5$ interrupt current paths that may be caused by the body diodes of the switches $S_2$ and $S_3$.

The following description of the operational change of the power recovery circuit 210 according to an embodiment of the present invention is with reference to FIGS. 3A, 3B, 3C, 3D and 4. The operation proceeds in the order of four modes by the manipulation of the switches $S_1$, $S_2$, and $S_3$. The phenomenon called "LC resonance" herein is not a continuous oscillation but a change in voltage and current caused by the combination of the inductor L and the panel capacitor $C_p$ when the switch $S_2$ or $S_3$ is turned on.

In the embodiment of the present invention, it is assumed that before the start of Mode 1, the switch $S_1$ is "on" and the switches $S_2$ and $S_3$ are "off" to sustain a terminal voltage $V_p$ of the panel capacitor $C_p$ at the address voltage Va. It is also assumed that the inductance of the inductor $L_1$ and $L_2$ are $L_{a1}$ and $L_{a2}$, respectively.

Figure 3A:
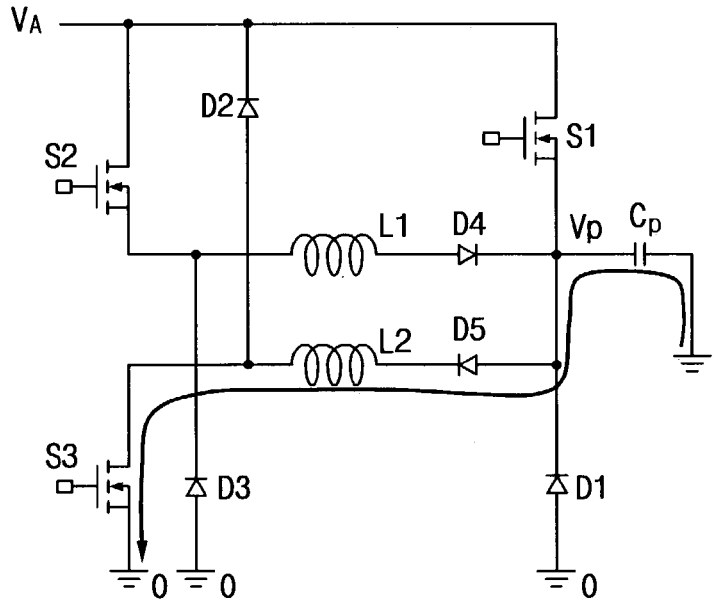
FIGS. 3A, 3B, 3C and 3D are illustrations showing the current paths in the respective modes of the power recovery circuit according to the embodiment of the present invention.
Figure 4:
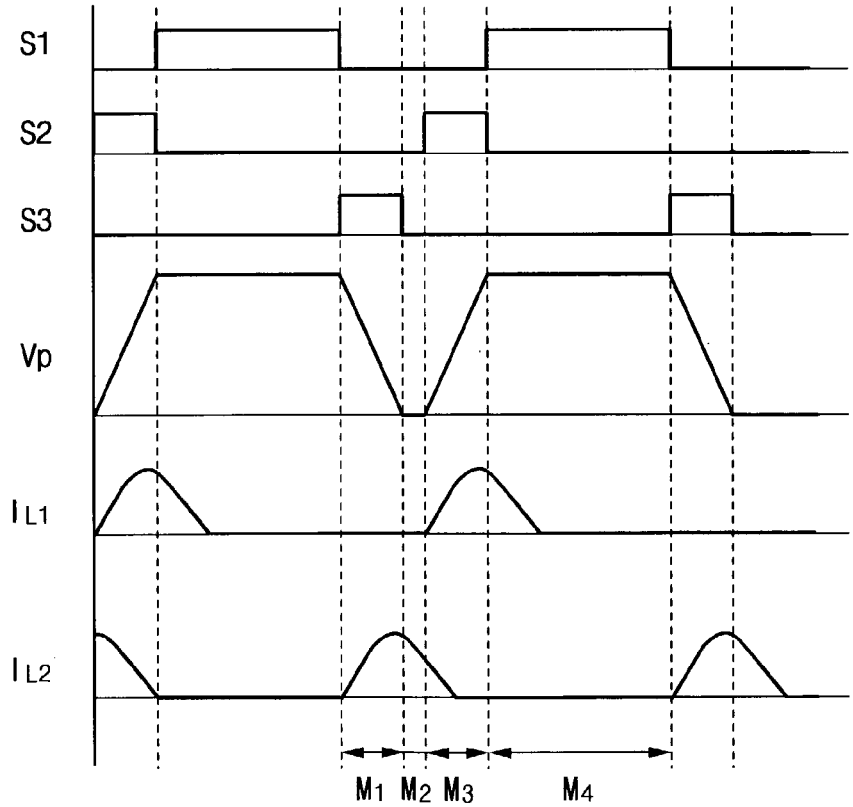
FIG. 4 is a timing diagram of the power recovery circuit according to the embodiment of the present invention.

Referring to FIGS. 3A and 4, in Mode 1 (M1), the switch S1 is turned off and the switch S3 is turned on to form a current path that includes panel capacitor $C_p$, diode $D_5$, inductor $L_2$, and switch $S_3$. Due to the panel capacitor $C_p$ and the inductor $L_2$, an LC resonance current flows in the current path. This resonance current increases a current $I_{L2}$ flowing to the inductor $L_2$ to store energy in the inductor $L_2$, thus reducing the terminal voltage $V_p$ of the panel capacitor $C_p$ from the address voltage $V_a$ to 0V. That is, the energy in the panel capacitor $C_p$ is stored in the inductor $L_2$.

Figure 3B:
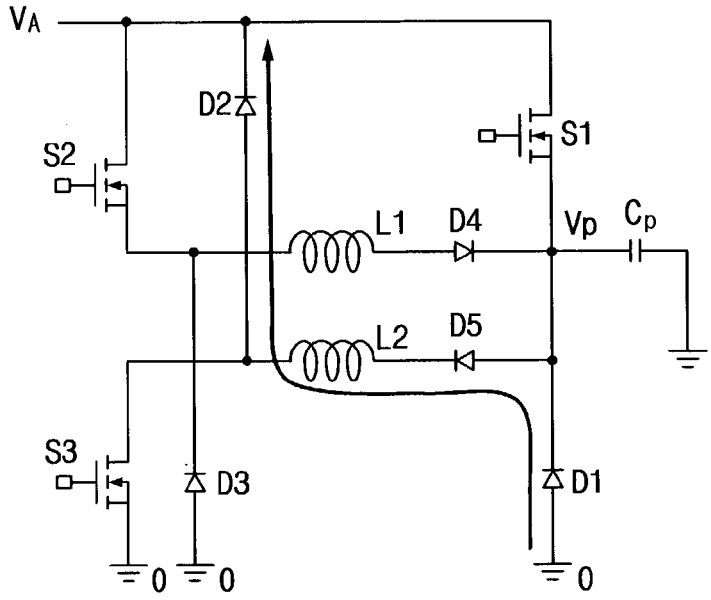

In Mode 2 (M2), the switch $S_3$ is turned off when the terminal voltage $V_p$ of the panel capacitor $C_p$ is reduced to the ground voltage. With the switch $S_3$ off, a current $I_{L2}$ flowing to the inductor $L_2$ flows on a current path including diode $D_1$, diode $D_5$, inductor $L_2$, and diode $D_2$, as shown in FIG. 3B, and linearly decreases with a slope of $V_a/L_2$. That is, the energy stored in the inductor $L_2$ is recovered to the power source $V_A$, and the terminal voltage $V_p$ of the panel capacitor $C_p$ is sustained at 0V.

Figure 3C:
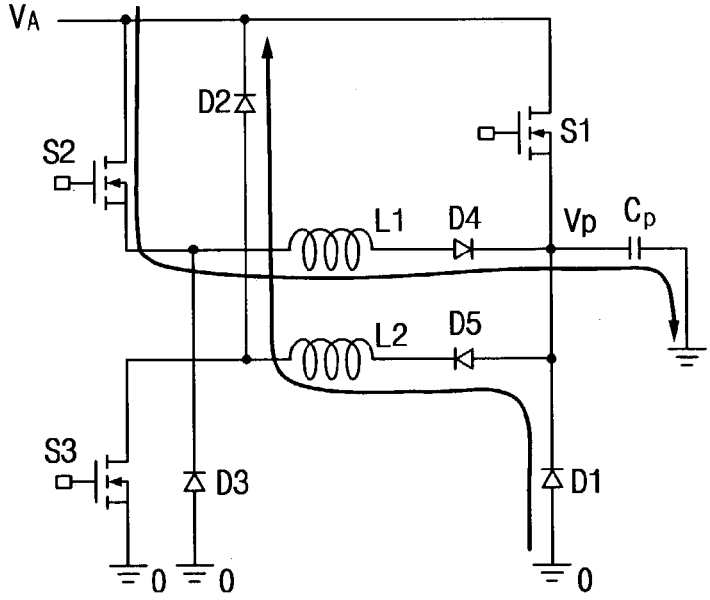

Referring to FIG. 3C and, in Mode 3 (M3), the switch $S_2$ is turned on while the current $I_{L2}$ flowing to the inductor $L_2$ is decreased. Then a current path is formed that includes switch $S_2$, inductor $L_1$, diode $D_4$, and panel capacitor $C_p$, so that the LC resonance current flows due to the panel capacitor $C_p$ and the inductor $L_1$. This resonance current increases the current $I_{L1}$ flowing to the inductor $L_1$ to store energy in the inductor $L_1$, thus raising the terminal voltage $V_p$ of the panel capacitor $C_p$ from 0V to the address voltage $V_a$.

The current $I_{L2}$ flowing to the inductor $L_2$ continuously flows to the power source $V_A$ until it reaches 0A, so that the energy stored in the inductor $L_2$ is recovered to the power source $V_A$.

Figure 3D:
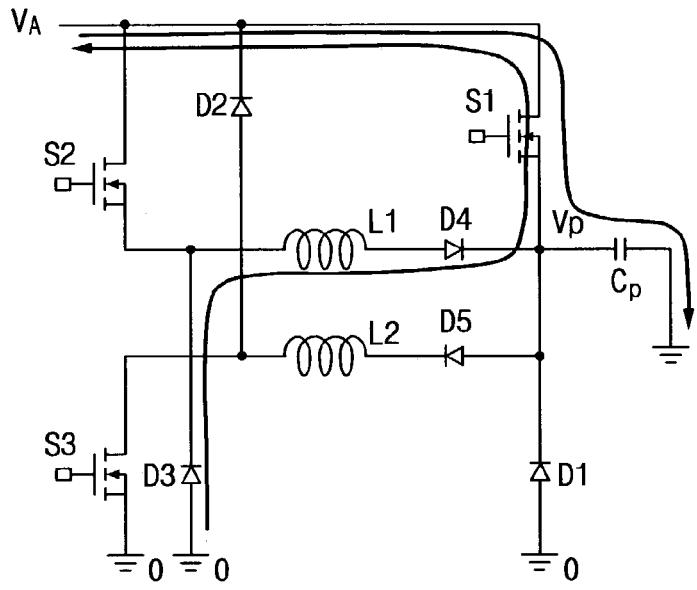

Referring to FIGS. 3D and 4, in Mode 4 (M4), the switch $S_2$ is turned off and the switch $S_1$ is turned on while the terminal voltage $V_p$ of the panel capacitor $C_p$ is increased to the power source $V_A$. With the switch $S_1$ on, a current path is formed that includes address voltage $V_a$, switch $S_1$, and panel capacitor $C_p$. The terminal voltage $V_p$ of the panel capacitor $C_p$ can therefore be sustained at the address voltage $V_a$.

When the switch $S_2$ is turned off and, the terminal voltage $V_p$ of the panel capacitor $C_p$ reaches the address voltage $V_a$, the body diode of the switch $S_1$ conducts. Then the current $I_{L1}$ flowing to the inductor $L_1$ flows on a path including diode $D_3$, inductor $L_1$, diode $D_4$, and the body diode of switch $S_1$, and it linearly decreases to 0A with a slope of $V_a/L_1$. That is, the energy stored in the inductor $L_1$ is recovered to the power source $V_A$.

Subsequently, the procedures of Modes 1 to 4 are repeated so that the terminal voltage $V_p$ of the panel capacitor $C_p$ is repeatedly switched between the address voltage $V_a$ and the ground voltage.

According to the present invention, the terminal voltage $V_p$ of the panel capacitor $C_p$ is changed when the current flowing to the inductors $L_1$ and $L_2$ is increased from 0A to maximum, because of LC resonance. Also, the terminal voltage $V_p$ of the panel capacitor $C_p$ is increased before the current of the inductors is completely reduced. That is, the terminal voltage $V_p$ of the panel capacitor $C_p$ is changed using a ¼ resonance. This enables high-speed addressing, compared with the conventional circuits using a half resonance. In addition, the terminal voltage $V_p$ can be completely raised to the address voltage or lowered to the ground voltage irrespective of the power recovery rate.

The energy stored in the inductors $L_1$ and $L_2$ is recovered to the address voltage $V_a$, causing no circulating current. The resonance paths during charge and discharge of the panel capacitor $C_p$ are separated from each other to reduce the rise/fall time of the address voltage. This can also make the rise time different from the fall time.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

Having thus described our invention, what we claim as new and desire by Letters Patent is as follows:

1. An apparatus for driving a plasma display panel, which includes a plurality of address electrodes, a plurality of scan electrodes and a plurality of sustain electrodes arranged in pairs, and a panel capacitor formed among the address electrodes, the scan electrodes, and sustain electrodes, the apparatus comprising:

a first switch and a first diode coupled in series between a first power source for supplying a first voltage and a second power source for supplying a second voltage, a contact between the first switch and the first diode being coupled to one terminal of the panel capacitor;

a first inductor and a second inductor, each having one terminal thereof coupled in parallel to the contact between the first switch and the first diode;

a second switch coupled between the first power source and the other terminal of the first inductor;

a third switch coupled between the other terminal of the second inductor and the second power source;

a second diode coupled between the first power source and the other terminal of the second inductor; and a third diode coupled between the other terminal of the first inductor and the second power source.

2. The apparatus of claim 1, further comprising:

a fourth diode coupled between the first inductor and the panel capacitor; and a fifth diode coupled between the panel capacitor and the second inductor.

3. The apparatus of claim 1, wherein the first voltage is an address voltage and the second voltage is a ground voltage.

4. The apparatus of claim 1, wherein the first switch has a body diode.

5. An apparatus for driving a plasma display panel, which includes a plurality of address electrodes, a plurality of scan electrodes and a plurality of sustain electrodes arranged in pairs, and a panel capacitor formed among the address electrodes, the scan electrodes and the sustain electrodes, the apparatus comprising:

a first signal line and a second signal line for supplying a first voltage and a second voltage, respectively; and a first inductor and a second inductor coupled to one terminal of the panel capacitor, wherein a first current path for reducing a voltage of the panel capacitor from the first voltage to the second voltage is formed from the panel capacitor to the second signal line via the second inductor, wherein a second current path is formed to recover a current flowing to the second inductor to the first signal line, when the voltage of the panel capacitor is sustained at the second voltage, wherein a third current path for increasing the voltage of the panel capacitor from the second voltage to the first voltage is formed from the first signal line to the panel capacitor via the first inductor while the current flowing to the second inductor is recovered, and wherein a fourth current path is formed to recover a current flowing to the first inductor to the first signal line, while the voltage of the panel capacitor is sustained at the first voltage.

6. The apparatus of claim 5, wherein the current flowing to the second inductor on the first current path is changed to have a ¼ sine wave cycle by a resonance between the panel capacitor and the second inductor.

7. The apparatus of claim 5, wherein the current flowing to the first inductor on the third current path is changed to have a ¼ sine wave cycle by a resonance between the panel capacitor and the first inductor.

8. The apparatus of claim 5, wherein the terminal voltage of the panel capacitor reaches the first voltage and second voltage when the currents flowing to the first inductor and second inductor are respectively at maximum.

9. The apparatus of claim 5, further comprising:

a first switch coupled between the first inductor and the first signal line; and a second switch coupled between the second inductor and the second signal line, wherein the first current path and third current path are formed when the second switch and first switch are turned on, respectively.

10. The apparatus of claim 9, further comprising:

a first diode formed between the second signal line and the one terminal of the second inductor; and a second diode formed between the other terminal of the second inductor and the first signal line, the second current path being formed via the first and second diodes.

11. The apparatus of claim 9, further comprising:

a first diode formed between the second signal line and the one terminal of the first inductor; and a second diode formed between the other terminal of the first inductor and the first signal line, wherein the fourth current path is formed via the first diode and the second diode.

12. The apparatus of claim 11, further comprising:

a third switch having the second diode as a body diode, wherein the panel capacitor is sustained at the first voltage when the third switch is turned on.

13. The apparatus of claim 5, wherein the first voltage is an address voltage and the second voltage is a ground voltage.

14. A method for driving a plasma display panel, which includes a plurality of address electrodes, a plurality of scan electrodes and a plurality of sustain electrodes arranged in pairs, and a panel capacitor formed among the address electrodes, the scan electrodes and the sustain electrode, the method comprising steps of:

(a) changing a voltage of the panel capacitor charged to a first voltage to a second voltage using an LC resonance with a first inductor coupled to the panel capacitor;

(b) sustaining the terminal voltage of the panel capacitor at the second voltage while recovering a current flowing to the first inductor to a first power source for supplying the first voltage;

(c) changing the voltage of the panel capacitor to the first voltage using an LC resonance with a second inductor coupled to the panel capacitor, while the current flowing to the first inductor is recovered to the first power source; and (d) sustaining the terminal voltage of the panel capacitor at the first voltage while recovering a current flowing to the second inductor to the first power source.

15. The method of claim 14, wherein the current flowing to the first inductor is maximum when the voltage of the panel capacitor reaches the second voltage, and wherein the current flowing to the second inductor is maximum when the voltage of the panel capacitor reaches the first voltage.

16. The method of claim 14, wherein the step (a) further comprises a step of:

switching a first switch coupled between the first inductor and a second power source for supplying the second voltage to form the LC resonance, and wherein the step (c) further comprises a step of:

switching a second switch coupled between the second inductor and the first power source to form the LC resonance.

17. The method of claim 14, wherein the step (b) further comprises a step of:

recovering the current flowing to the first inductor with a current path including a second power source for supplying the second voltage, the first inductor and the first power source, wherein the step (d) further comprises a step of:

recovering the current flowing to the second inductor with a current path including the second power source, the second inductor and the first power source.

18. The method of claim 14, wherein the step (d) further comprises a step of:

sustaining the terminal voltage of the panel capacitor at the first voltage by switching a switch coupled between the panel capacitor and the first power source.

19. The method of claim 14, wherein the first voltage is an address voltage and the second voltage is a ground voltage.

* * * * *